United States Patent [19]

Hoffmann

[11] Patent Number: 4,642,087

[45] Date of Patent: Feb. 10, 1987

[54] ONE-SIDED CORRUGATED CARDBOARD MACHINE

[75] Inventor: Martin Hoffmann, Tangstedt, Fed. Rep. of Germany

[73] Assignee: Werner H. K. Peters Maschinen Fabrik GmbH, Hamburg, Fed. Rep. of Germany

[21] Appl. No.: 660,870

[22] Filed: Oct. 15, 1984

[30] Foreign Application Priority Data

Nov. 7, 1983 [DE] Fed. Rep. of Germany ... 8331822[U]

[51] Int. Cl.[4] ..... B31F 1/20

[52] U.S. Cl. ..... 493/463; 72/244; 156/205

[58] Field of Search ..... 493/463, 464, 477, 480, 493/434; 156/205; 72/244, 35, 36

[56] References Cited

U.S. PATENT DOCUMENTS

| | | | |
|---|---|---|---|
| 1,856,170 | 6/1929 | Roux | 72/244 |
| 3,053,309 | 9/1962 | Wilson et al. | 156/205 |
| 3,919,029 | 12/1975 | Osgood | 156/205 |

FOREIGN PATENT DOCUMENTS

| | | | |
|---|---|---|---|
| 53509 | 10/1970 | Australia | 72/244 |
| 2337150 | 2/1975 | Fed. Rep. of Germany | 72/244 |
| 1179115 | 1/1970 | United Kingdom | 72/248 |

*Primary Examiner*—Francis S. Husar
*Assistant Examiner*—Robert Showalter
*Attorney, Agent, or Firm*—Harness, Dickey & Pierce

[57] ABSTRACT

A one-sided corrugated cardboard machine comprising a machine stand, an upper and a lower fluted roller as well as a pressure roller cooperating with the lower fluted roller and pivotally supported on lever arms at the machine stand, adjustable abutment surfaces at the machine stand associated with the lever arms, and an adjusting mechanism supported at the machine stand and cooperating with the lever arms which to adjust the pressure roller nip urge the lever arms against the abutments, with the abutment surface arranged to face the pressure roller nip and limiting the movement of the lever arms away from the pressure roller nip.

5 Claims, 2 Drawing Figures

ONE-SIDED CORRUGATED CARDBOARD MACHINE

BACKGROUND OF THE INVENTION

The invention relates to a one-sided corrugated cardboard machine comprising a machine stand, an upper and a lower fluted roller as well as a pressure roller cooperating with the lower fluted roller and pivotably supported on lever arms at the machine stand, adjustable abutments at the machine stand associated with the lever arms, and adjusting means supported at the machine stand and cooperating with the lever arms, said adjusting means pressing the lever arms against the abutment surfaces in order to adjust the pressure roller nip.

Such one-sided corrugated cardboard machines have been known for a long time. The lower fluted roller is fixedly supported with respect to its axis of rotation in the machine stand, while the upper fluted roller is pivotably supported at lever arms and is pressed against the lower fluted roller with the aid of a pneumatic or hydraulic arrangement. The pressure roller is likewise pivotally supported at lever arms. But the pressure roller cannot be readily pressed against the lower fluted roller because this would entail a so-called stumbling run owing to the running-off movement of the corrugation of the fluted roller on the cylindrical pressure roller. For this purpose, abutments are provided at the machine stand which delimit the movement of the pressure roller onto the lower fluted roller. The abutments are adjustable in order to adapt the width of the nip to the thickness of the paper. With the aid of a hydraulic or pneumatic contact pressure means the levers which are extended beyond the bearing point of the pressure roller are pressed in a direction towards the lower fluted roller.

The known construction, however, suffers from certain disadvantages. The contact pressure means must press the lever fastly against the abutments so that even with greater forces effective in the roll nip the latter will not be widened. For this purpose a contact pressure means is required which must be designed for great forces. Even if it is formed by hydraulic pressure cylinders, a certain yieldingness cannot be avoided. Therefore, there is a danger of a certain oscillation of the lever arms in dependence upon forces occurring in different degrees in the roll nip. Such an oscillation, however, is undesirable for several reasons. It may impair the quality of the paper. Furthermore, noises will be created in a substantial degree. Also the roller lifetime will be negatively influenced thereby. Finally, with greater forces, the levers supporting the pressure rollers may experience a certain deflection thereby impairing the accuracy of the roll nip.

It is the object of the innovation to counteract such disadvantages and, in particular, to provide a bearing means for the pressure roller enabling an especially quiet run of the pressure roller.

SUMMARY OF THE INVENTION

This object is attained in accordance with the innovation in that the abutment surfaces are arranged to face the pressure roller nip and delimit the movement of the lever arms away from the pressure roller nip.

In the one-sided corrugated cardboard machine according to the innovation the lever arms of the pressure roller are not forced against an abutment which delimits the movement of the pressure roller in the direction towards the fluted roller. Rather, the abutment surfaces are facing in the opposite direction, i.e. they delimit the movement of the pressure roller away from the fluted roller. The delimitation of the roll nip thus is effected via a rigid mechanical connection. It has been found that such an arrangement leads to a running movement of the pressure roller which is by far smoother than with the known machines in which forces effective in a direction away from the lower fluted roller must be intercepted by a hydraulic or pneumatic device.

The smooth running movement obtainable of the pressure roller has a noticeable positive effect on the quality of the corrugated cardboard. Another advantage resides in that only a minor force needs to be exerted in order to hold the lever arms against the associated abutments. The adjusting means, therefore, only serve to prevent the lever arms from lifting off the abutments. But this is not normally the case anyway because the lever arms are resting on the abutments under their own weight or that of the pressure roller, respectively. In the case of the known machine, the adjusting device must overcome this weight, in order to keep the lever arm tightly against the abutments.

According to one embodiment of the innovation the adjusting device preferably is a draw gear. It may be formed, for instance, by hydraulic cylinders.

In order to obtain nevertheless with very great forces in the roll nip a certain yieldingness the abutments, according to another embodiment of the innovation, are supported on a rigid spring arrangement. The spring arrangement may be formed for instance by a pack of plate springs which will yield, for example, when double layers of paper are passing through the roll nip.

As already mentioned, the position of the abutments determines the size of the roll nip. As the latter must be changed in accordance with the thicknesses of the paper, provision is made in another embodiment of the innovation for the abutments to be formed of wedges which are arranged in common on a shaft of adjustment and cooperate with oblique surfaces of the levers. The shaft of adjustment may for instance be driven by a motor and provided with an actuator which may cooperate with an automatic processing control. With the aid of such an adjustment of the abutments the levers may also be adjusted individually, which has proved to be advantageous.

BRIEF DESCRIPTION OF THE DRAWINGS

The innovation will be described in the following in more detail by way of drawings.

DETAILED DESCRIPTION OF THE PREFERRED EMBODIMENTS OF THE INVENTION

Figure 2:
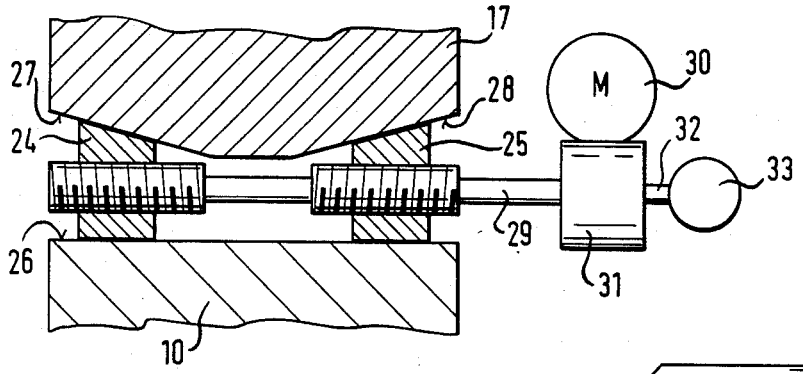
FIG. 2 shows a sectional view of the representation according to FIG. 1 taken on line 2—2.
Figure 1:
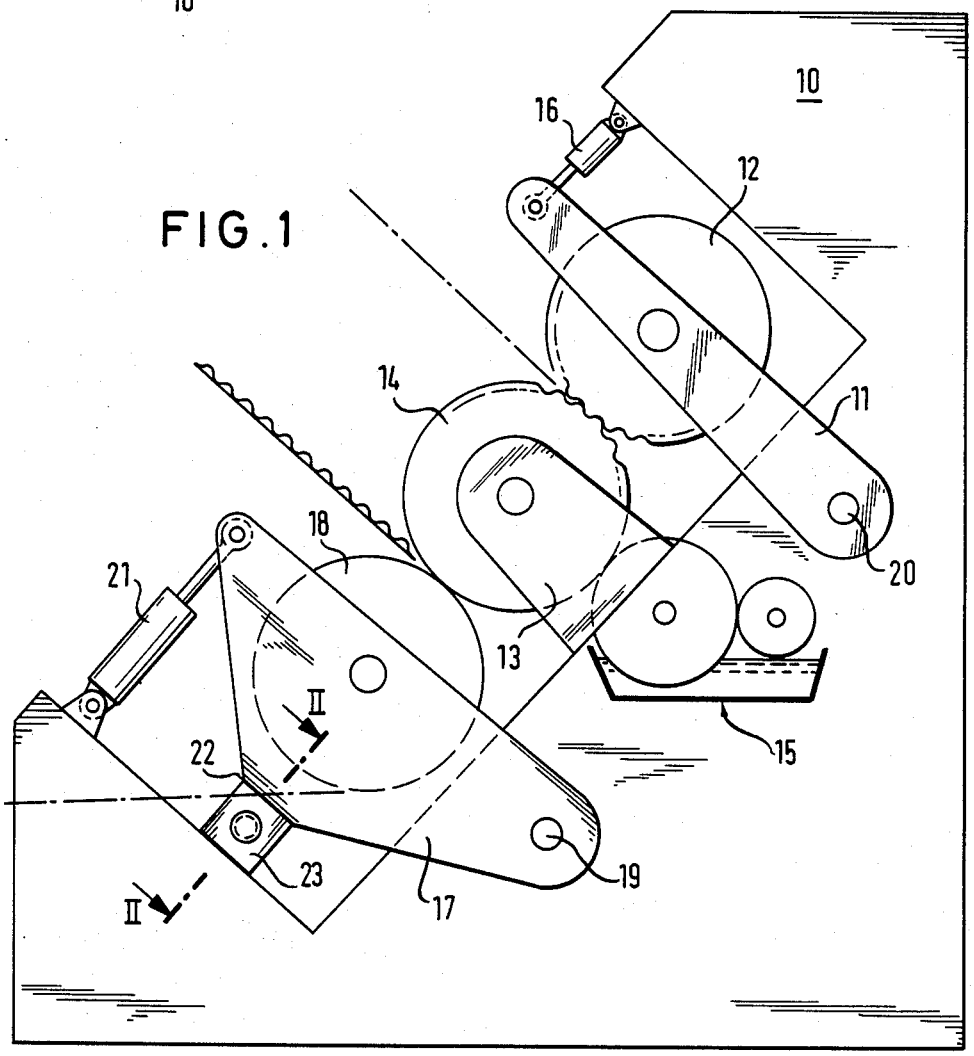
FIG. 1 shows a lateral view of a one-sided corrugated cardboard machine.

Prior to enlarging in more detail on the individual representations shown in the drawings, it is to be stated that each of the features described is of essential importance to the innovation by itself and in connection with features of the claims.

The drawings are extremely schematic and not to scale.

The machine stand of a one-sided corrugated cardboard machine is generally designated with 10. Supported on levers one of them being shown at 11 is an upper fluted roller 12. A lower fluted roller 14 is rotatably supported on a bracket 13 and cooperates in a manner known per se with the upper fluted roller 12. Cooperating with the lower fluted roller 14 also is a applicator device 15 to apply glue. The portion of the lever 11 extending beyond the pivot point of the upper fluted roller 12 is connected to a hydraulic cylinder 16. Thereby, the fluted roller 12 may be forced against the fluted roller 14.

With the aid of lever arms one of them being shown at 17, a pressure roller 18 is pivotally supported in the machine stand. The lever 17 is pivotally supported in the machine stand 10, as shown at 19. The pivot point of the lever 11 for the upper roller 12 is designated 20. The portion of the lever 17 extending beyond the pivot point of the pressure roller 18 is articulated to a hydraulic cylinder 21 which at the other end is articulated to the machine stand 10. On the side of the lever 17 which faces away from the lower fluted roller 14 there is provided an abutment surface 22. Said abutment surface cooperates with an abutment 23 supported on the machine stand 10. The adjusting cylinder 21 serves to hold the lever 17 against the abutment 23. In the absence of any opposing forces, the lever 17 lies in contact against the abutment 23 by its own weight and that of the pressure roller 18, respectively. With certain vibrations only a certain lifting of the lever 17 from the abutment 23 might occur. This is prevented by the adjustment cylinder 21.

As will be recognized from FIG. 2, the abutment 23 is formed by two wedges 24, 25 which are supported at an abutment surface 26 of the machine stand 10. On the opposite side they are formed with an oblique surface cooperating with oblique abutment surfaces 27, 28 of the lever 17. Th abutment surfaces 27 , 28 on the lever converge towards the center. By moving the wedges 24, 25 towards each other the lever thus is adjusted in a direction towards the lower fluted roller 14. In the opposite direction the lever 17 is adjusted in a sense away from the fluted roller 14. The wedges 24, 25 are seated on left and right hand thread portions of a shaft of adjustment 29 which may be driven from a motor 30 via a transmission 31. Fitted at the transmission shaft 32 is furthermore a measured value indicator 33. It is possible with the aid of an automatic control to adjust the respective position of the wedges 24, 25. The measured value indicator 33 represents the respective position of the shaft 29 and thus that of the wedges 24, 25. The position thereof determines the width of the nip. This may be digitally indicated, for example, by deduction from the measured value indicator signal.

It should still be noted that the force of the lever 17 when lying in close contact against the abutment 23 is still increased by the pulling force of the paper. In the case of known machines the pulling force of the paper may under certain circumstances be so strong as to bring about a transitory adjustment of the lever arms away from the abutments resulting in a transitory increase of the roll nip.

I claim:

1. A one-sided corrugated cardboard machine comprising a machine stand, an upper and a lower fluted roller, a pressure roller cooperating with the lowr fluted roller, said pressure roller being pivotally supported by lever arms at the machine stand for pivotal movement toward and away from said lower fluted roller, adjustable abutment surfaces at the machine stand associated with the lever arms, an adjusting means supported at the machine stand and cooperating with the lever arms, characterized in that said adjusting means provides for adjustment of the pressure roller nip, said abutment surfaces being arranged to face the pressure roller nip and limit the pivotal movement of the lever arms only in the direction away from the lower fluted roller and permitting movement of said lever arms and said pressure roller toward said lower fluted roller.

2. A corrugated cardboard machine according to claim 1, characterized in that the lever arms lie in close contact against the abutment surface under its own weight and the weight of the pressure roller.

3. A corrugated cardboard machine according to claim 1, characterized in that the abutment surface is formed by wedges arranged in common on a shaft of adjustment and cooperating with oblique surfaces of the levers.

4. A corrugated cardboard machine according to claim 2, characterized in that the abutments are formed by wedges arranged in common on a shaft of adjustment and cooperating with oblique surfaces of the levers.

5. A corrugated cardboard machine according to claim 3, further including indicator means for indicating the angular position of the shaft of adjustment and accordingly the distance between the pressure roller and the lower fluted roller.

* * * * *